United States Patent [19]

Koza

[11] 4,174,857

[45] Nov. 20, 1979

[54] GAME TICKET

[75] Inventor: John R. Koza, Atlanta, Ga.

[73] Assignee: Canadian Tag & Label Ltd., Sparta, Mich.

[21] Appl. No.: 865,202

[22] Filed: Dec. 28, 1977

[51] Int. Cl.[2] ..... B42D 15/00

[52] U.S. Cl. ..... 283/6; 283/8 R; 283/9 R

[58] Field of Search ..... 283/6, 8 R, 9 R, 12 A

[56] References Cited

U.S. PATENT DOCUMENTS 3,900,219 8/1975 D'Amato et al. ..... 283/6

FOREIGN PATENT DOCUMENTS 1185066 3/1970 United Kingdom ..... 283/6
1441489 6/1976 United Kingdom ..... 283/6
1457998 12/1976 United Kingdom ..... 283/6

*Primary Examiner*—Travis S. McGehee
*Attorney, Agent, or Firm*—John A. Mitchell; Pasquale A. Razzano

[57] ABSTRACT

A game ticket which is particularly useful as a lottery ticket is claimed. The ticket basically comprises at least a base sheet and a cover sheet which are adhesively joined together in a peripheral portion. Information to be concealed is placed on the surface of the base sheet which faces the cover sheet. This information is concealed by covering it with a suitable, removable material which is opaque thus concealing the information until the opaque material is removed. In order to provide security for the ticket so that the purchaser may be sure that no one has been able to determine whether or not it is a winning ticket prior to being opened by the purchaser, a tear line of perforations extends through the cover and base sheets and the ticket must be torn along this line to gain access to the covered or concealed information. The use of postage stamp perforations helps to insure that any attempt to pry the various portions of the ticket apart will cause a tear or misalignment of holes at the perforation line and alert or warn the purchaser to the fact that the ticket may have been compromised. In addition, the cover and base sheets may be made from a laminate of paper and metallic foil further insuring the security of the ticket. In a further embodiment the combination includes a bottom sheet which is affixed to the base sheet so that a three layer ticket consisting of cover, base and bottom sheets is provided. The bottom sheet acts as a further security for the ticket and is particularly useful when impact type printers are used to imprint the concealed information.

28 Claims, 7 Drawing Figures

FIG. 1
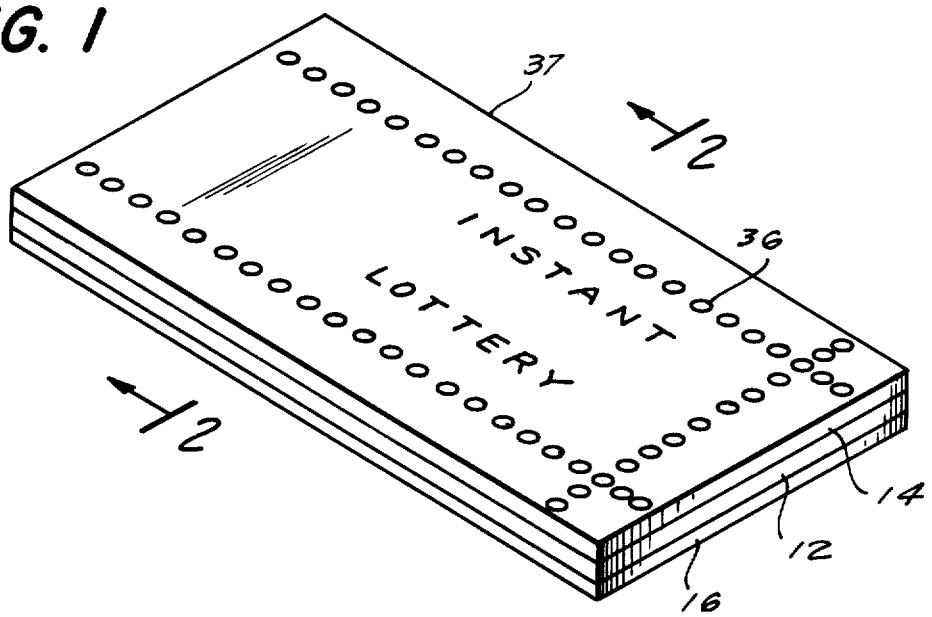
FIG. 2
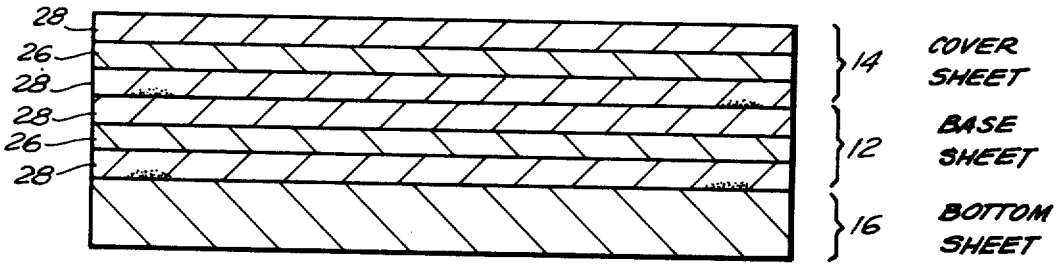
FIG. 4
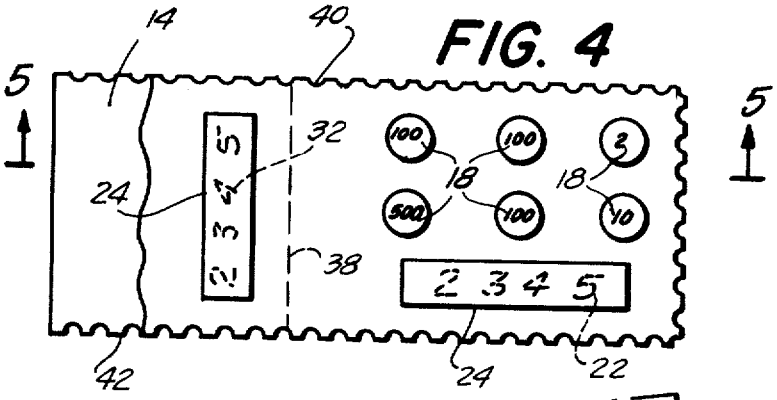
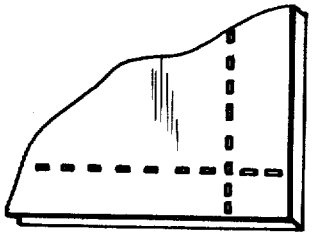
FIG. 6
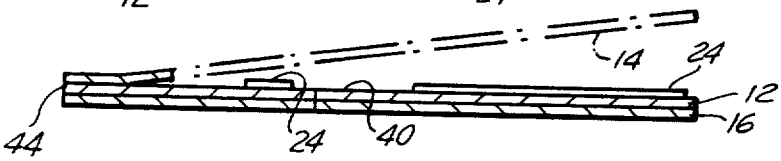
FIG. 5

FIG. 3
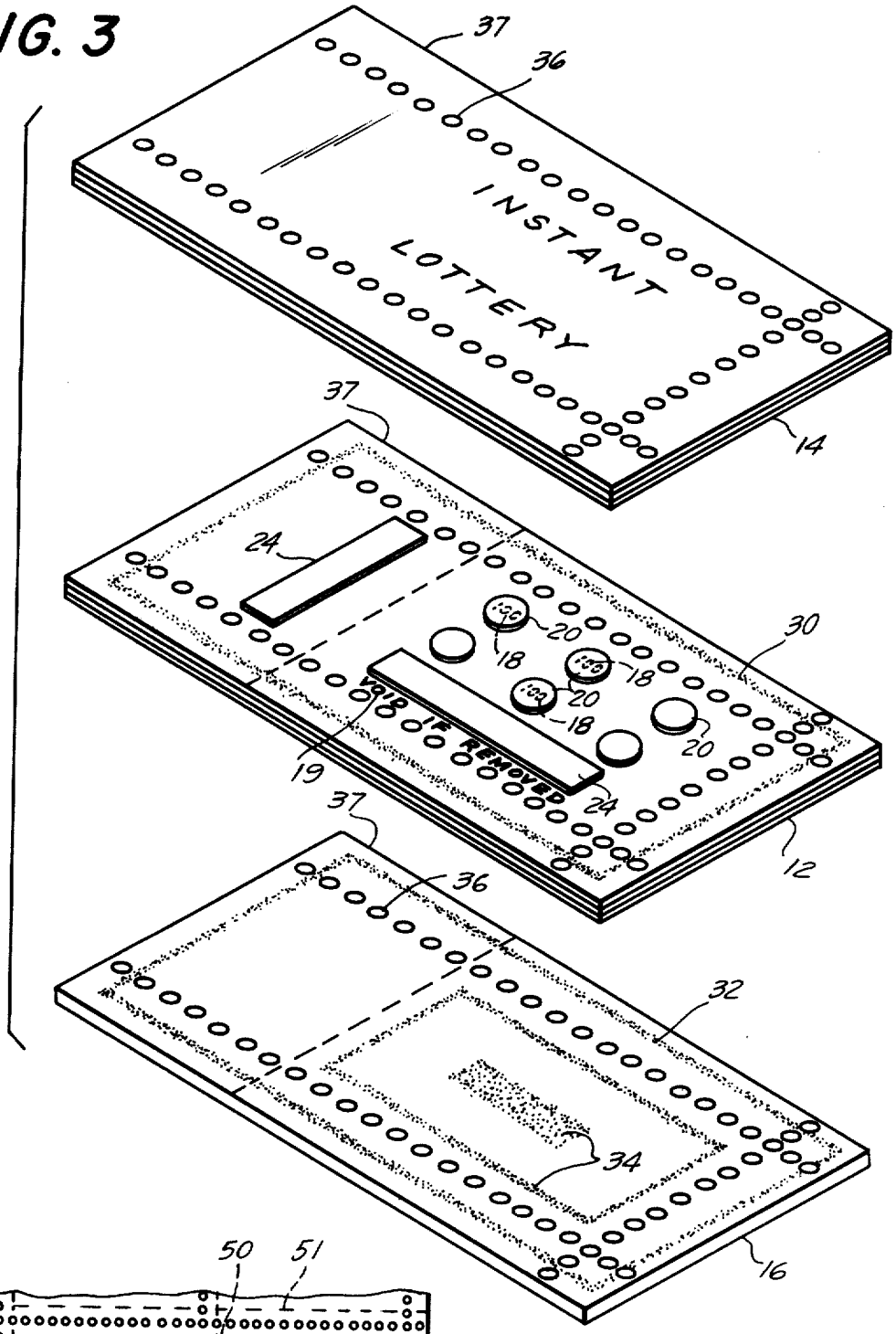
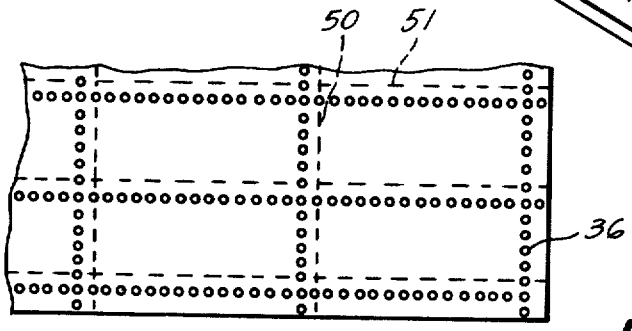
FIG. 7

GAME TICKET

SUMMARY OF THE INVENTION

The present invention is usable for game tickets where it is desired to have on the ticket information which cannot be observed without destroying the integrity of the ticket. The invention is particularly suited for use in lotteries, such as lotteries of the instant type.

Lotteries have become increasingly popular and one type of lottery is known as the "instant lottery". An instant lottery is generally one where the purchaser of the lottery ticket is able to determine immediately whether or not he has obtained a winning ticket. Usually, winning is determined by removing a covering of some kind to gain access to concealed information. For example, the uncovered information may indicate that the holder of the ticket is entitled to a money prize.

One of the key problems with instant lottery tickets is to insure that an unscrupulous person is not able to examine the tickets before distribution to the public and to determine which are winners and which are losers. With the present invention a ticket is provided which is considered to be secure against all known means of viewing the concealed information without actually opening the ticket.

Basically, the ticket includes a cover and base sheet and the concealed information is placed on the base sheet with the peripheral portions of the two sheets adhesively affixed together. The information is placed in a central portion of the ticket and a postage stamp perforation tear line is applied through both the base and cover sheet, the tear line being positioned between the area where the information is placed and the peripheral portion where the two sheets are adhesively joined together. By using the postage stamp perforation if someone attempts to pull the two sheets apart, each of the sheets should separate at the tear line and indicate to the purchaser that the ticket has been tampered with; or the misalignment of the holes would indicate that other methods of opening had been used. It is a further security measure that the sheets are preferably made from a laminate of paper and metallic foil. The metallic foil acts as a barrier to prevent the concealed information from being observed by applying a strong light to the ticket. In addition the paper layer of the laminate when adhesively joined to the other sheet would destructively delaminate if someone attempted to pry the sheets apart.

To make tampering generally profitable a large number of tickets must be readily and easily broken without any visible signs being left. It one were able to successfully break the security of the ticket of the present invention, the time and effort needed to overcome each of the barriers would make the endeavor unprofitable because the tickets have a relatively small average value in prizes.

Accordingly, it is an object of the present invention to provide a game ticket which is easily assembled but is not susceptible to tampering without being noted. It is a further object of the present invention to provide a lottery game ticket which requires a definite act on the part of the ticket purchaser to gain access to concealed information so that the purchaser may be assured that the ticket has not been compromised.

While in the accompanying drawings and in the detailed description of the illustrated embodiment one form of the ticket envisioned by the present invention is shown and described, it will be apparent to those skilled in the art that other embodiments may be made without departing from the scope and spirit of the invention.

IN THE DRAWINGS

FIG. 1 is a perspective view of a game ticket in accordance with the present invention;

FIG. 2 is a sectional view through the ticket of FIG. 1;

FIG. 3 is an exploded view showing in perspective the three sheet components of the ticket of FIG. 1;

FIG. 4 is a plan view showing the base sheet of the ticket of FIG. 1 after access has been gained to it by removing the peripheral portion of the ticket along a perforated tear line;

FIG. 5 is a sectional view through the ticket of FIG. 4;

FIG. 6 is a partial perspective view showing a ticket having a crush perforated tear line rather than a postage stamp perforation; and FIG. 7 is a plan view of a sheet incorporating a plurality of tickets made according to the present invention.

DETAILED DESCRIPTION OF THE ILLUSTRATED EMBODIMENT

Referring to the drawings and to FIGS. 1 and 2 in particular, a game ticket 10 in accordance with the present invention is shown. The ticket 10 consists of a base sheet 12, a cover sheet 14 and a bottom sheet 16. The bottom sheet 16 is an optional component as will be discussed later.

As shown in FIGS. 3 and 4, information 18 to be concealed is placed on the base sheet 12, covered by a concealment "rub-off" coating of an individual area for each bit of information or a single large common area 20 and access to the information is gained by removing the coating material 20. The information 18 which is to be concealed in the case of a lottery ticket would normally appear as winning numbers, letters or symbols. For example, in the illustrated embodiment a winning ticket of a lottery of the instant type is shown. In the illustrated lottery it is necessary for the holder of the ticket to find the same amount of money listed three times in the concealed information. In this winning ticket the sum of $100 is shown three times.

In addition to the winning information it is often desirable to have validation information printed on the ticket, the validation information 22 optionally being covered by a concealment coating 24. After the winning combination has been found by removing the coating 20, the issuing authority can check the ticket for validation purposes by removing the optional concealment coating 24 to expose the validation information 22.

The concealed information 18 and 22 can be applied to the base sheet 12 by any well known printing means. If a non-contact printing method (or method with low pressure printed and non-printed areas on the substrate) is used, it is not necessary to have the bottom sheet 16 since no relief impression will be made by the printer on the base sheet 12. If, on the other hand, an impact printing technique is used it may be possible to see the indentation of the concealed information 18 on the underside of the base sheet 12. In such a case the bottom sheet 16 acts as a security barrier against the information 18 being revealed without opening the ticket. In this connection the terms impact printed and impact printing as used herein are intended to refer to computer printers, letter presses and even numbering devices wherein the printed information is applied to the substrate with the impact of a character device.

The type of ink which is used for printing the information 18 can also serve as a security measure. One type of ink which may be used is known to those in the art as fugitive inks. A fugitive ink is one which reacts to the application of strong light, heat or solvents. If the information 18 after it has been learned by removing the concealment coating 20 is attempted to be altered by use of a solvent, a fugitive ink will immediately react and indicate to the validating authorities or players that there has been tampering with the ticket. If heat or strong light are used the ink will once more show there there has been a tampering. It is well known to those in the art to compound inks which will react to various sources of heat, light and/or solvents to disclose that there has been an attempt to alter the information or construction of the ticket. In addition to printing the concealed information with fugitive inks, or even in lieu thereof, a test spot or pattern, or other non-concealed information 19 printed on the ticket can be printed with a fugitive ink for security purposes.

After the information has been applied to the base sheet 12, the concealment coating 20 is next applied. Preferably the concealment coating is made of a removable material which is opaque and which dries rapidly after being applied. Cellulose acetate and latex compositions may be used for the coating and applied in one or more layers. To facilitate the coating's removal, a release coat of a suitable covering such as varnish is first applied over the information to be concealed. Preferably the concealment coating is an oqaque material applied in two or more layers. If the two or more layers used are of different colors, densities and composition that will further increase the security of the ticket. Also by using two or more such layers an interface is formed between the layers which will disperse light and make it extremely difficult if not impossible to see the concealed information through the concealment coating even under extremely high intensity or infrared lighting conditions. When a large common area of concealment coating is used individual graphic designs can be overprinted over each individual piece of concealed information to suggest the location of the individual pieces of concealed information.

Advantageously the base sheet may be in the form of a laminate of paper and metallic foil. In such a construction a ply of metallic foil 26 is covered on each side by a ply of thin paper 28 which are joined together usually by an adhesive, thus making a three part laminate. The information to be concealed is printed on one of the paper layers 28. The metallic foil 26 which is solid and opaque acts as a shield for the information and prevents it from being read by use of a strong light or other devices which might permit one to view the information 18 if only paper were used for the ticket.

The base sheet 12 and the cover sheet 14 are joined to each other by an adhesive coating 30 after the information and the concealment coatings have been applied to the sheet 12. If one is used, the bottom sheet 16 is also applied to the base sheet 12 by means of a second peripheral adhesive coat 32 and by a centrally positioned adhesive coating 34. Preferably, the adhesive coating has an adhesive strength which is greater than the tear strength of the paper layers of the base sheet of the metallic foil of the cover sheet. By this arrangement if any attempt is made to separate the cover and base sheets they will tear at the adhesive coating, i.e. they destructively delaminate, providing a visual indication that the ticket has been previously opened and possibly tampered with.

After the sheets 12, 14 and 16 have been adhesively joined together, a tear line 36 is provided about one or all of the periphery sides of the ticket by means of a perforation such as that used for postage stamps. These perforations are made from male and female dies which punch round holes in the ticket along the tear line and urge the edge of the holes in one layer into the other. Another useful form of tear line for the ticket of the present invention is a crush perforation produced by pressing the ticket between a sharp toothed rule and a flat surface. This presses one layer into the other and tears the layer slightly at the substrate but does not necessarily puncture the ticket.

The tear line 36 is advantageously positioned between the peripheral adhesive coatings 30 and 32 and the information to be concealed 18 and 22. If one were to attempt to tamper with the composite ticket 10 by prying apart the sheets 12 and 14, one of the adjacent paper layers 28 of the laminate would most likely tear at the adhesive line 30 and 32. If there was not a tearing of at least one of the adjacent paper layers 28, there would undoubtedly be a tearing at the tear line 36 which is formed by the perforations. This tearing would result from the nature of the perforations as well as from the thinness of the paper layer which makes up the outer laminate layer of sheets 12 and 14. Moreover, even if the ticket layers did not tear, when the cover sheet is replaced on the base sheet, after tampering, the perforations in the two sheets would not re-align properly or in the same positions they had when originally punched. This misalignment will also provide a positive physical indication of possible tampering.

After a ticket has been punched, in order to gain access to the concealed information, the edge of the ticket is torn along the tear line 36, a tear strip 37 is removed from the composite ticket 10 and access is gained to the central portion of the base sheet 12. The user then removes the concealment coating 20 usually by scratching or rubbing with a coin in order to view the concealed information 18. If the ticket is a winning one as shown in FIG. 4, the purchaser may then sever the winning portion 40 from the optional stub 42 which is formed from the stub portions 44 and 46 of the base sheet and the bottom sheet. The validation information 22 remains on the tab 42 and on the main portion 40 still covered by the optional concealment coating 24. After the ticket has been determined by the reviewing authority to be a winning one it may be checked to see that it is properly validated by removing the coating 24.

As noted earlier, the use of the bottom sheet 16 is optional depending upon the type of printing method which is used to apply the information to be concealed. Even if a non-contact printing method is used, for security purposes it still may be desirable to use a bottom sheet 16. The bottom sheet 16 is normally made from any suitable paper board stock, such as a card board or kraft paper, so long as it has sufficient thickness and weight to give some support to the composite ticket 10. In addition to serving as a security barrier the bottom sheet 16 also adds stiffness to the ticket so that it may be easily handled.

The tickets of the present invention are preferably printed and formed in multiples by successive printing and operating steps performed on individual sheets or in a continuous process on a continuous sheet of stock. When the manufacturing process is completed a sheet or continuous string of tickets, as seen in FIG. 7, results that has a plurality of tickets therein each separated by perforation lines 50 and 51 similar to, but preferably weaker than the perforations of ticket tear line 36. In this manner strips or rows of tickets can be separated or cut (e.g. along lines 50) from the sheet, fan folded, and assembled into books. Then the individual tickets can be separated from one another along lines 51. Preferably the base and cover sheets 12, 14 are adhered together in a rectangular grid defined by the adhesive 37 to set off the individual ticket areas 53. The perforations 50, 51 are formed in the adhesive grid to permit the tickets to be separated from one another affecting the tear lines 36.

Information concerning the playing of the game or redemption rules may be applied to the underside of the ticket 10 or either side of the cover sheet 14 along with a decorative coating as desired.

While the illustrated embodiment has been described as a game ticket usable with an instant lottery game, it may be used for any other type of game or lottery.

What is claimed is:

1. A game ticket having concealed information thereon, said ticket comprising:

a base sheet having the information to be concealed on one side thereof, and a cover sheet overlying the information and affixed to the base sheet;

said cover sheet including an optical barrier sheet secured thereto about the entire periphery of the cover sheet and being joined to the base sheet along the entire peripheral area of the sheets;

said base sheet also including a separate optical barrier sheet secured thereto about the entire periphery of the base sheet;

the information to be concealed being positioned within the area defined by the joined peripheral portions of the base and cover sheets whereby it is optically concealed by the optical barrier sheets in both the base and cover sheets;

an opaque removable material on the base sheet overlying and obscuring the information whereby it is concealed upon removal of the cover sheet from the base sheet;

a tear line of perforations in the cover and base sheets extending between at least a portion of the peripheral area of the sheets and the area of the base sheet containing the information whereby the cover and base sheets are adapted to be torn along the tear line to obtain access to the concealed information.

2. A game ticket as defined in claim 1 wherein the base sheet is formed from a laminate of at least two plys, one ply being formed of an ink receptive material and in facing relation to the cover sheet, the second ply being said optical barrier sheet which is non-translucent to obscure from view information placed on the ink receptive ply.

3. A game ticket as defined in claim 2 wherein the ink receptive ply is made of paper and the second ply is a metallic foil.

4. A game ticket as defined in claim 1 and further including a bottom sheet affixed to the base sheet at least in a peripheral area of the sheets, with a central area of the base sheet underlying the area containing the concealed information on the base sheet, the tear line of perforations extending through the bottom sheet.

5. A game ticket as defined in claim 4 wherein the bottom sheet is made of paper board stock.

6. A game ticket as defined in claim 4 wherein the information to be concealed is applied to the base sheet by printing and produces an impression of the information in the base sheet which is hidden from view by said bottom sheet.

7. A game ticket having concealed information thereon, said ticket comprising:

a base sheet having the information to be concealed on one side thereof, and a cover sheet overlying the information and affixed to the base sheet;

the cover sheet joined to the base sheet in a peripheral area of the sheets;

the information to be concealed being positioned within the area defined by the joined peripheral portion of the sheets;

an opaque removable material overlying and obscuring the information whereby it is concealed;

a tear line of perforations in the cover and base sheets extending between at least a portion of the peripheral joined area of the sheets and the area of the base sheet containing the information whereby the cover and base sheets are adapted to be torn along the tear line to obtain access to the concealed information;

said opaque removable material being applied over at least one release coating applied to the base sheet and over the information to be concealed.

8. A game ticket as defined in claim 1 wherein the information to be concealed is printed with a fugitive ink.

9. A game ticket as defined in claim 1 wherein said opaque removable material comprises at least two layers of opaque removable material producing an interface therebetween.

10. A game ticket as defined in claim 1 wherein said tear line is formed as a line of postage stamp perforations.

11. A game ticket as defined in claim 1 wherein said tear line is formed as a line of crush perforations.

12. A game ticket as defined in claim 1 including exposed indicia in said base sheet printed with a fugitive ink.

13. A game ticket having information thereon, said ticket comprising:

a multi-layer base sheet laminate having the information to be concealed on one side thereof, and a multi-layer cover sheet overlying the information and affixed to the base sheet;

the base and cover sheets each being formed from a laminate of ink receptive material and metallic foil defining an optical barrier; said ink receptive material and foil being secured together about their peripheries, said sheets being adhesively joined together at their entire peripheral portions, the adhesive bond between the sheets being of sufficient strength to cause at least one of said sheets to destructively delaminate before the adhesive bond can be broken;

the information to be concealed being placed on the ink receptive surface of the base sheet and positioned within the area of the adhesively bonded peripheral portion of the sheets;

an opaque removable material on said base sheet overlying and obscuring the information whereby it is concealed;

a tear line of perforations in the cover and base sheets extending between the peripheral adhesively joined area of the sheets and the area of the base sheet containing the information whereby the cover and base sheets are adapted to be torn along the tear line to obtain access to the concealed information; and the tear line being of lesser extent than the full periphery of the base and cover sheets whereby said sheets remain adhesively joined at one portion thereof after the sheets are separated along the tear line.

14. A game ticket having information thereon, said ticket comprising:

a multi-layer base sheet laminate having the information to be concealed on one side thereof, and a multi-layer cover sheet overlying the information and affixed to the base sheet;

the base and cover sheets being formed from a laminate of ink receptive material and metallic foil, said sheets being adhesively joined together at their peripheral portion, the adhesive bond between the sheets being of sufficient strength to cause at least one of said sheets to destructively delaminate before the adhesive bond can be broken;

the information to be concealed being placed on the ink receptive surface of the base sheet and positioned within the area of the adhesively bonded peripheral portion of the sheets;

an opaque removable material overlying and obscuring the information whereby it is concealed;

a tear line of perforations in the cover and base sheets extending between the peripheral adhesively joined area of the sheets and the area of the base sheet containing the information whereby the cover and base sheets and adapted to be torn along the tear line to obtain access to the concealed information; and the tear line being of lesser extent than the full periphery of the base and cover sheets whereby said sheets remain adhesively joined at one portion thereof after the sheets are separated along the tear line; and a cut line formed in the base sheet, said cut line being positioned adjacent the portion of the base sheet which remains adhesively joined to the cover sheet after the sheets are separated along the tear line whereby the part of the base sheet having the concealed information is adapted to be separated from the rest of the game ticket.

15. A game ticket as defined in claim 14 wherein additional concealed information is placed on the portion of the base ticket adapted to be separated and the portion of the base sheet affixed to the cover sheet, whereby said concealed information may be used to validate the authenticity of the original concealed information.

16. A game ticket as defined in claim 13 wherein the information to be concealed is formed from fugitive inks.

17. A game ticket as defined in claim 13 including exposed indicia in said base sheet printed with a fugutive ink.

18. A game ticket as defined in claim 13 wherein said removable materials comprises two layers of opaque removable material producing an interface therebetween.

19. A game ticket as defined in claim 13 wherein said tear line is formed as a line of postage stamp perforations.

20. A game ticket as defined in claim 13 wherein said tear line is formed as a line of crush perforations.

21. A game ticket as defined in claim 13 further including a bottom sheet affixed to the base sheet in at least a peripheral area of the sheets, with a central area of the base sheet underlying the area containing the concealed information on the base sheet, the tear line of perforations extending through the bottom sheet.

22. A game ticket as defined in claim 21 wherein the information to be concealed is applied to the base sheet by printing and produces an impression of the information in the base sheet which is hidden from view by said bottom sheet.

23. A game ticket as defined in claim 22 wherein the bottom sheet is made of paper board stock.

24. A game ticket having information thereon, said ticket comprising:

a multi-layer base sheet laminate having the information to be concealed on one side thereof, and a multi-layer cover sheet overlying the information and affixed to the base sheet;

the base and cover sheets being formed from a laminate of ink receptive material and metallic foil, said sheets being adhesively joined together at their peripheral portion, the adhesive bond between the sheets being of sufficient strength to cause at least one of said sheets to destructively delaminate before the adhesive bond can be broken;

the information to be concealed being placed on the ink receptive surface of the base sheet and positioned within the area of the adhesively bonded peripheral portion of the sheets;

an opaque removable material overlying and obscuring the information whereby it is concealed;

a tear line of perforations in the cover and base sheets extending between the peripheral adhesively joined area of the sheets and the area of the base sheet containing the information whereby the cover and base sheets are adapted to be torn along the tear line to obtain access to the concealed information; and the tear line being of lesser extent than the full periphery of the base and cover sheets whereby said sheets remain adhesively joined at one portion thereof after the sheets are separated along the tear line; and at least one release coat being applied to the base sheet over the information to be concealed and between said information and the opaque removable material.

25. A game ticket as defined in claim 13 wherein the base sheet is formed from a three ply laminate of paper, matallic foil and paper with the metallic foil being positioned between the paper plies.

26. A game ticket having concealed information thereon, said ticket comprising:

a base sheet having the information to be concealed on one side thereof, and a cover sheet overlying the information and affixed to the base sheet;

the cover sheet joined to the base sheet in a peripheral area of the sheets;

the information to be concealed being positioned within the area defined by the joined peripheral portion of the sheets;

an opaque removable material overlying and obscuring the information whereby it is concealed;

a tear line of perforations in the cover and base sheets extending between at least a portion of the peripheral joined area of the sheets and the area of the base sheet containing the information whereby the cover and base sheets are adapted to be torn along the tear line to obtain access to the concealed information; and a cut line formed in the base sheet, said cut line being positioned adjacent the portion of the base sheet which remains adhesively joined to the cover sheet after the sheets are separated along the tear line whereby the part of the base sheet having the concealed information is adapted to be separated from the rest of the game ticket.

27. A game ticket as defined in claim 26 wherein additional concealed information is placed on the portion of the base ticket adapted to be separated and the portion of the base sheet affixed to the cover sheet, whereby said concealed information may be used to validate the authenticity of the original concealed information.

28. A sheet of game tickets each having concealed information thereon comprising:

a base sheet having a plurality of areas thereon each defining an individual ticket; said base sheet having printed thereon in substantially all of said areas on one side thereof, information to be concealed;

a cover sheet overlying said base sheet, said cover sheet being joined to said base sheet along lines separating the individual ticket areas along the periphery of said ticket areas;

said base sheet having an opaque removable material placed near said information to be concealed;

said cover and base sheets having a first set of perforations formed therein between said ticket areas to enable individual tickets to be separated and a second set of perforations in each ticket area inwardly of the peripheral joined area of the ticket area between said joined area and the portion of the ticket area containing said information whereby after an individual ticket is separated from the sheet of tickets the cover and base sheets are adapted to be torn along said second set of perforations to obtain access to the concealed information;

said base and cover sheets each being formed of a laminate of ink receptive material and metallic foil defining an optical barrier, said ink receptive material and foil being secured together at least adjacent said lines separating the individual ticket areas.

* * * * *